United States Patent [19]

Meredith

[11] Patent Number: 5,021,127

[45] Date of Patent: Jun. 4, 1991

[54] EXTENDED DELIGNIFICATION IN PRESSURE DIFFUSERS

[75] Inventor: Michael D. Meredith, Glens Falls, N.Y.

[73] Assignee: Kamyr, Inc., Glens Falls, N.Y.

[21] Appl. No.: 413,682

[22] Filed: Sep. 28, 1989

Related U.S. Application Data

[62] Division of Ser. No. 127,055, Dec. 1, 1987, abandoned.

[51] Int. Cl.[5] ..... D21C 7/00

[52] U.S. Cl. ..... 162/237; 162/243; 162/248; 162/249; 162/251

[58] Field of Search ..... 162/19, 55, 57, 60, 162/237, 243, 248, 249, 251

[56] References Cited

U.S. PATENT DOCUMENTS

| | | | |
|---|---|---|---|
| 2,675,311 | 4/1954 | Natwick | 162/237 |
| 3,035,963 | 5/1962 | Schnyder | 162/19 |
| 3,372,087 | 3/1968 | Richter | 210/388 |
| 3,575,795 | 4/1971 | Brinkley et al. | 162/19 |
| 3,579,420 | 5/1971 | Richter | 162/237 |
| 4,104,113 | 8/1978 | Sherman et al. | 162/237 |
| 4,123,318 | 10/1978 | Sherman | 162/237 |
| 4,368,628 | 1/1983 | Jacobsen | 210/388 |
| 4,432,836 | 2/1984 | Sherman et al. | 162/237 |
| 4,436,586 | 3/1984 | Elmore | 162/19 |
| 4,690,731 | 9/1987 | Hartler et al. | 162/45 |
| 4,705,600 | 11/1987 | Jacobsen | 162/19 |

FOREIGN PATENT DOCUMENTS 1173603 9/1984 Canada .

OTHER PUBLICATIONS

Knutson et al, World Pulp and Paper Week Proc., "Pressure Diffuser—A New Versatile Pulp Washer"; 97–99; Apr. 10–13, 1984, abstract.

Southern Pulp & Paper 48, No. 6: 14–15 (Jun., 1985), abstract; "Pressure Diffuser . . . ".

Kleppe et al, TAPPI, vol. 59, No. 11, 1976, "Oxygen-/Alkali Delignification . . . ".

Phillips, "Kamyr Diffusion Washing" paper presented at CPPA, Montreal, Quebec, Jan. 27, 1976, Kamyr Diffusion Washing.

*Primary Examiner*—Peter Chin

*Attorney, Agent, or Firm*—Nixon & Vanderhye

[57] ABSTRACT

Extended delignification of kraft pulp in a pressure diffuser allows a pulp mill with a digester (e.g. continuous digester) to increase its production capacity without building a new line, or to decrease its demand in its bleach plant, or to increase the strength of softwood pulp it produces. Comminuted cellulosic fibrous material is kraft cooked to produce kraft pulp having a blow temperature over about 300° F. The pulp is diffusion treated in the first stage of a pressure diffuser to replace the water around the pulp with delignifying liquor. The liquor has a dissolved lignin concentration of less than 12% (optimally less than about 4%), has an effective alkali concentration of at least 2 gm/l (preferably 8–55 gm/l), and a temperature of at least about 300° F. Treating the pulp with the delignifying liquor significantly reduces the K-number (e.g. on the order of about 5). After extended delignification, the pulp is washed in subsequent stages of the pressure diffuser. The components of the delignifying area of the pressure diffuser are of stainless steel to avoid corrosion from the alkaline liquor.

2 Claims, 1 Drawing Sheet

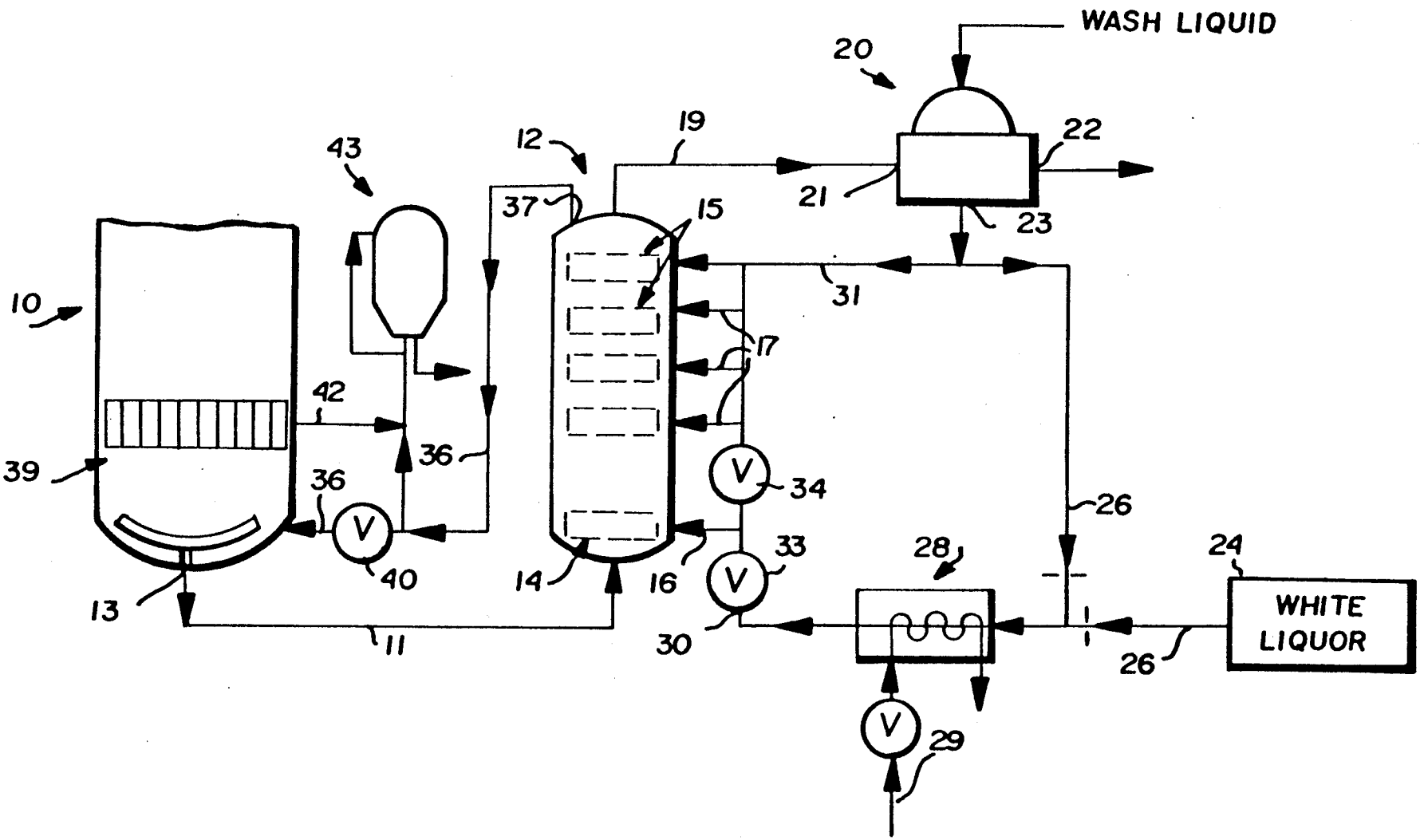
WASH LIQUID
WHITE LIQUOR
10
11
12
13
14
15
16
17
19
20
21
22
23
24
26
26
28
29
30
31
33
34
36
36
37
39
40
42
43

EXTENDED DELIGNIFICATION IN PRESSURE DIFFUSERS

This is a division of application Ser. No. 07/127,055, filed Dec. 1, 1987, abandoned.

BACKGROUND AND SUMMARY OF THE INVENTION

In many facilities with continuous digesters for producing kraft pulp, the mills have reached their production capacity yet would like to increase their pulp production without the necessity for building entire new lines. Other mills would like to decrease the demand in their bleach plants. Other mills wish to increase the strength of softwood pulp so that the proportion of softwood pulp in paper making, or other applications, can be increased. All of these objectives can be achieved according to the present invention by providing extended kraft delignification using a pressure diffuser.

According to the present invention, a pressure diffuser is operatively connected to the pulp discharged from a continuous digester. No, or very little, washing is done in the bottom of the digester, therefore the entire digester can be devoted to cooking, and thus production can be increased. Any wash liquid that is supplied to the bottom of the digester is throttled or heated so that the pulp discharged from the digester is at high temperature, typically having a blow temperature over about 300° F., if extended delignification is to be immediately practiced thereafter.

By providing a particular treatment liquid and by taking advantage of the efficient diffusion that is possible using a pressure diffusion washer, it is possible to effect further delignification in the pressure diffuser. A pressure diffuser is a commercially available piece of equipment, sold by Kamyr, Inc. of Glens Falls, N.Y. and Kamyr AB of Karlstad, Sweden. Such a diffuser is illustrated and described in Canadian patent 1,173,603, and in an article entitled "Pressure Diffuser—A New Versatile Pulp Washer" by Knutson et al, SPCI-84 World Pulp and Paper Week Proc., Apr. 10–13, 1984, pp. 97–99.

In the first stage of a pressure diffuser, delignifying liquor is added to the pulp. The purpose in adding the liquor is to replace the water around the pulp fibers with the delignifying liquor. This is effectively accomplished by supplying the liquor to the pulp at a liquor-to-water (in the pulp) ratio of about 0.2–1.3.

The delignifying liquor must have a low concentration of dissolved lignin (i.e. a low dissolved solids content). Typically the water in the pulp has a dissolved solids concentration of about 12 to 16%. The delignifying liquor must have a concentration less than 12%, and preferably about half (e.g. 6%) or less of the pulp water concentration, and optimally 4% or less. The alkali concentration must be at least 2 gm/l effective alkali ($Na_2O$), and preferably is at least about 8 gm/l, and about 20–55 gm/l is particularly effective. The delignifying liquor also must be at high temperature. The exact temperature will depend upon the blow temperature of the pulp (or other pulp temperature where extended delignification is not practiced immediately after continuous digesting). The higher the temperature of the pulp actually encountered by the delignifying liquor, the lower its temperature need be. Typically, however, the temperature of the delignifying liquor must be at least about 300° F., and for a blow temperature of about 320° F. would optimally be around 315° F.

By replacing the water around the pulp fibers with delignifying liquor, the K-number of the pulp is significantly reduced. In actual working examples of the invention, the K-number has been reduced, on some occasions, over 6, a very significant reduction.

Since mild steel, typical of some equipment that is in pressure diffusers, corrodes when subjected to alkaline solutions at high temperatures, for extended operation according to the invention it is necessary to provide the first wash liquid inlet (and associated components) of the pressure diffuser of a material, such as stainless steel, having good corrosion resistant properties. For subsequent inlets and related components in the pressure diffuser conventional materials may be utilized. A washing liquid is applied to the other inlets in the pressure diffuser to effect washing of the pulp.

A pressure diffuser is particularly suited for the extended delignification according to the present invention. A pressure diffuser washes pulp at very high pressures and temperatures, and the diffusion action has been shown to be very effective. The apparatus according to the invention comprises a continuous digester with a pulp discharge at the bottom, and a multiple stage pressure diffuser having a pulp inlet, a pulp outlet, and a screened liquid outlet. As described above, the first stage is made of corrosion resistant material, and a treatment liquid inlet is provided to each stage. The apparatus further includes treatment means, such as a vacuum drum washer, having a pulp inlet, a pulp outlet, and a filtrate outlet; a source of white liquor; and liquid heating means. A first conduit transports pulp from the bottom of the digester to the pulp inlet of the pressure diffuser, while a second conduit transports pulp from the diffuser pulp outlet to the treatment means pulp inlet. A third conduit supplies a portion of the filtrate from the treatment means filtrate outlet, mixed with white liquor from the white liquor source, to the heating means. A fourth conduit supplies a heated mixture of white liquor and filtrate from the heating means to the treatment liquid inlet to the diffuser first stage, and a fifth conduit supplies wash liquid to the treatment liquid inlet of subsequent stages of the pressure diffuser, including at least some liquid from the filtrate outlet. Optionally, a sixth conduit may be provided for supplying screened liquid from the diffuser screened liquid outlet to the bottom of the digester for effecting a small amount of washing, with throttling valve means disposed in the sixth conduit for regulating the flow of screened liquid into the bottom of the digester. Any washing done in the digester is merely to effect removal of some dissolved lignin, but without reducing the pulp temperature to the extent that the desired K-number reduction is destroyed.

It is the primary object of the present invention to provide an effective method and apparatus for the extended kraft delignification of pulp. This and other objects of the invention will become clear from an inspection of the detailed description of the invention and from the appended claims.

BRIEF DESCRIPTION OF THE DRAWING

The drawing schematically illustrates exemplarly apparatus according to the present invention for practicing a method of extended kraft delignification.

DETAILED DESCRIPTION OF THE DRAWING

A continuous digester 10 is operatively connected by first conduit means 11 to a pressure diffuser 12. The continuous digester 10 preferably is of the type supplied by Kamyr, Inc. of Glens Falls, N.Y. or Kamyr AB of Karlstad, Sweden, having pulp discharge 13 at the bottom thereof. The pressure diffuser 12 also is of the type supplied by Kamyr and it has a plurality of wash liquid inlets and related components, which are illustrated in dotted line in the drawing, the first inlet and components being indicated by reference numeral 14, and the subsequent inlets and components by reference numeral 15. The first liquid inlet 16, and the inlets 17 are the subsequent inlets.

After treatment in the pressure diffuser 12, pulp is discharged through conduit means 19 from the top of the diffuser 12 to a treatment means 20. The treatment means 20, as schematically illustrated in the drawing, comprises a vacuum drum, which provides a washing action to the pulp. Alternatively, and in fact preferably, the washer 20 may comprise a diffusion washer, or a second pressure diffuser. Vacuum drum 20 is supplied with clean wash liquid or the like, and has a pulp inlet 21, a pulp outlet 22, and a filtrate outlet 23.

The apparatus according to the invention also comprises a source of white liquor, 24. Third conduit means 26 provide for mixing of some of the filtrate from vacuum drum 20 with white liquor from source 24, and supply of the mixture to a liquid heating means 28. The liquid heating means 28, as illustrated in the drawing, preferably comprises a conventional indirect heater in which steam is provided in a closed loop within the heater 28 through pipe 29 or the like. A fourth conduit 30 provides heated alkali liquor from heater 28 to the inlet 16 to the first stage of the diffuser 12, while fifth conduit means 31 provides "cool" filtrate from vacuum drum 20 to the subsequent stages 15 of the diffuser 12.

For the embodiment actually illustrated in the drawing, valves 33 and 34 are provided. Those valves are provided merely because the system illustrated in the drawing is retrofit onto an already existing system. The valves 33, 34 are necessary to isolate the first stage of the diffuser 12 from the others, when extended delignification is being practiced. For example when extended delignification is being practiced the valve 34 will be closed and the valve 33 will be opened. If it is desired not to practice extended delignification using the pressure diffuser 12, then the valve 34 is opened and the valve 33 closed (and the white liquor source 24 is disconnected).

An optional desirable feature according to the invention is to provide some modest amount of washing at the bottom of the digester. For this purpose a sixth conduit means 36 is provided for supplying screened liquid from the screened liquid outlet 37 of the diffuser 12 to the bottom of the digester 10, with a conventional Withdrawal screen system 39 adjacent the bottom of the digester 10 for withdrawing the wash liquid with dissolved lignin. A throttling valve 40 is provided in the conduit 36 to control the flow of wash liquid into the digester 10 so that the blow temperature of the digester 10 will be above about 300° F. The valve 40 will be controlled so that some washing takes place in digester 10 to effect removal of some dissolved lignin, but without reducing the pulp discharge temperature to the extent that the desired K-number reduction achieved by delignification in the pressure diffuser 12 is destroyed. Any screened liquid in conduit 36 not used for washing, and the spent wash liquor from discharge conduit 42 from screen assembly 39, is passed to a series of flash tanks or the like, the first flash tank 43 being schematically illustrated in the drawing.

The flow of white liquor and filtrate to the heater 28 will be controlled depending upon the desired effective alkali concentration of the delignifying liquor, as well as the desired dissolved lignin concentration of the delignifying liquor. It is necessary to have the dissolved solids content of the delignifying liquor supplied to stage 14 to be less than 12%, with about half or less of the dissolved solids content of the liquid surrounding the pulp in the discharge conduit 13 (e.g. about 6% or less) being desired. Optimally, the dissolved solids content will be 4% or less.

The delignifying liquor is supplied at a ratio of about 0.2–1.3 (liquor to water in the pulp), the ratio being lower when the effective alkali content of the liquor is higher.

Delignification occurs according to the invention if the effective alkali ($Na_2O$) concentration is at least 2 gm/l, but it is desirable to have the effective alkali concentration of at least about 8 gm/l, and about 20–55 gm/l is particularly effective. The heater 28 will be controlled so that the temperature of the hot alkali liquor is at least about 300° F., and typically will be about 315° F. The exact temperature will be dependent upon the blow temperature from the digester (or other temperature of the pulp at the time of treatment), the purpose being to achieve the desired reduction in K-number by extended delignification, while minimizing the use of energy. In general, for the illustrated embodiment, the higher the blow temperature, the lower the temperature the alkaline liquor can have.

Typical results achieved according to the present invention may be seen from Table I which follows. In the following table, columns A and B indicate one test, columns C and D a second, columns E and F a third, and columns G and H a fourth. "DIG" references the digester, while "PD" references the pressure diffuser. The pulp consistency is generally about the same throughout the treatment process, from the bottom of the digester through discharge from the pressure diffuser, being approximately 8–13%. The white liquor used in the test has an active alkali content of about 101 gm/l. Therefore in test C D and in test E F, the delignifying liquor had an effective alkali content of about 51 gm/l. Also in test C D, for example, the ratio of delignifying liquor to water in the pulp is about 0.25 (in view of the relatively high alkali concentration of the liquor). In all of the tests, the content of solids (dissolved lignin) in the pulp discharged from the digester was about 14.5%, while the solids concentration of the delignifying liquor was about 2–4%.

TABLE I

| Test | A | B | C | D | E | F | G | H |
|---|---|---|---|---|---|---|---|---|
| Vessel | DIG | PD | DIG | PD | DIG | PD | DIG | PD |
| Production Rate (ADBT/D) | 482 | 482 | 482 | 482 | 482 | 482 | 482 | 482 |
| Blow Flow (GPM) | 720 | 720 | 688 | 688 | 680 | 680 | 675 | 675 |

TABLE I-continued

| Test | A | B | C | D | E | F | G | H |
|---|---|---|---|---|---|---|---|---|
| Vessel | DIG | PD | DIG | PD | DIG | PD | DIG | PD |
| Production Rate (ADBT/D) | 482 | 482 | 482 | 482 | 482 | 482 | 482 | 482 |
| Blow Temp (°F.) | 305 | 305 | 322 | 322 | 320 | 320 | 310 | 310 |
| Wash Flow (GPM) | 850 | 850 | 850 | 850 | 850 | 850 | 850 | 850 |
| Wash Temp. (°F.) | 166 | 166 | 164 | 164 | 164 | 164 | 165 | 165 |
| Extraction (GPM) | 950 | 950 | 950 | 950 | 950 | 950 | 950 | 950 |
| Ext. Temp. (°F.) | 280 | 280 | 288 | 289 | 287 | 287 | 282 | 282 |
| White Liquor (GPM) | 50 | 50 | 80 | 80 | 83 | 83 | 0 | 0 |
| Filtrate Flow (GPM) | 95 | 95 | 80 | 80 | 83 | 83 | 148 | 148 |
| Temp. of White Liquor/Filtrate Mix (°F.) | 316 | 316 | 315 | 315 | 315 | 315 | 320 | 320 |
| K# | 34.4 | 30.9 | 32.3 | 26 | 31.6 | 26.6 | 29.6 | 28.8 |
| Reduction in K# | | 3.5 | | 6.3 | | 5.0 | | 0.8 |

Note in the above Table that although a very significant decrease in K-number takes place when practicing the invention (e.g. tests C D and E F, reductions of 6.3 and 5.0, respectively), when the flow of white liquor is terminated in test G H (by opening valve 34 and closing valve 33 and disconnecting source 24) the K-number reduction is not significant (0.8) despite the fact that the temperature of the liquid added in the first stage of the pressure diffuser is still very high (320° F.).

According to the method according to the present invention, kraft cooking of comminuted cellulosic fibrous material (such as wood chips) is practiced to produce kraft pulp having a consistency of about 8–13%. Where extended delignification takes place right after continuous digesting, and a low wash ratio is used, the blow temperature preferably is over about 300° F. It is ensured that the temperature is over about 300° F. by throttling with valve 40 the wash water in conduit 36 that flows into the digester 10. While some washing of the pulp takes place in the bottom of the digester to effect removal of some dissolved lignin, it is not enough washing to reduce the pulp temperature to the extent that the extended delignification (K-number reduction) desired is adversely affected.

The water around the pulp fibers of the cooked pulp is replaced with delignifying liquor having less than 12% dissolved solids, and optimally about 8% dissolved solids or less. The delignifying liquor has at least 2 gm/l effective alkali and preferably over 8 gm/l. The delignifying liquor may be provided by combining white liquor (e.g. with an active alkali content of 100 gm/l) from source 24 with filtrate from vacuum drum 20, and heating the mixture in the indirect heater 28 to raise the temperature over 300° F., and preferably to about 315° F.

The extended delignification in which the water around the pulp fibers is replaced with delignifying liquor preferably is accomplished by diffusion treating of the pulp with a delignifying liquor by supplying the liquor to the pulp at a liquor-to-water in the pulp ratio of 0.2–1.3, resulting in a significant reduction of the K-number.

The temperature of delignifying liquor is adjusted with respect to the blow temperature or flow of the pulp so as to optimize K-number reduction. When the blow temperature is about 320° F., the delignifying liquor temperature is about 315° F., with higher values for the delignifying liquor temperature for lower blow line temperatures, and lower values for higher blow line temperatures. Where a high wash ratio (e.g. 1.2) is used, the blow temperature of the pulp is not as important. If batch digesters are used, the pulp might need heating before practicing extended delignification according to the invention.

After the K-number of the pulp has been significantly reduced (e.g. about 6 in test C D in the Table) the pulp is diffusion washed, in later stages 15 in the pressure diffuser 12.

It will thus be seen that according to the present invention a method of effecting extended kraft delignification is provided. The method allows a pulp mill to increase pulp production without the necessity for building an entire new line, by practicing the extended delignification in the bottom of a pressure diffuser. Alternatively, a mill can use the extended delignification to decrease the demand in its bleach plants. Alternatively, the strength of the softwood pulp produced from the mill can be increased by decreasing the harshness of the digestion and compensating for that by extended delignification, so that the proportion of softwood pulp in paper making, or other applications, can be increased.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. Apparatus for producing extended kraft pulp delignification, comprising:

(a) a continuous digester comprising an upright vessel for effecting digestion of pulp therein, and including an inlet for comminuted cellulosic fibrous material at a top thereof, treatment zones, and a pulp discharge at a bottom thereof;

(b) a multiple stage pressure diffuser for effecting diffusion treatment of kraft pulp, including means for defining a first stage and means for defining at least one subsequent stage and having a pulp inlet, a pulp outlet, and a screened liquid outlet; and having a first wash liquid inlet and associated components of material resistant to corrosion from alkali liquid, and at least one subsequent wash liquid inlet and associated components;

(c) treatment means for treating kraft pulp, having a pulp inlet, a pulp outlet, and a filtrate outlet;

(d) a source of white liquor;

(e) liquid heating means;

(f) first conduit means for transporting pulp from the bottom of the digester of the pulp inlet to the pressure diffuser;

(g) second conduit means for transporting pulp from the diffuser pulp outlet to the treatment means pulp inlet;

(h) third conduit means for supplying a portion of the filtrate from the treatment means filtrate outlet mixed with white liquor from the white liquor source to the heating means;

(i) fourth conduit means for supplying a heated mixture of white liquor and filtrate from the heating means to the treatment liquid inlet to the diffuser first stage; and (j) fifth conduit means for supplying wash liquid to the subsequent wash liquid inlets of the pressure diffuser, including at least some liquid from the filtrate outlet.

2. Apparatus as recited in claim 1 further comprising sixth conduit means for supplying screened liquid from the diffuser screened liquid outlet to the bottom of the digester, and throttling valve means disposed in said sixth conduit means for regulating the flow of screened liquid into the bottom of the digester.

* * * * *